US006159911A

United States Patent [19]

Katafuchi

[11] Patent Number: 6,159,911

[45] **Date of Patent: *Dec. 12, 2000**

[54] DIESEL ENGINE OIL COMPOSITION

[75] Inventor: Tadashi Katafuchi, Ichihara, Japan

[73] Assignee: Idemitsu Kosan Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/060,260

[22] Filed: Apr. 15, 1998

[30] Foreign Application Priority Data

Apr. 16, 1997 [JP] Japan ..... 9-098845

[51] Int. Cl.[7] ..... C10M 129/00

[52] U.S. Cl. ..... 508/391; 508/460; 508/523; 508/525; 508/586

[58] Field of Search ..... 508/391, 460, 508/523, 525, 586

[56] References Cited

U.S. PATENT DOCUMENTS

| | | | |
|---|---|---|---|
| 3,852,204 | 12/1974 | Souillard et al. | 508/391 |
| 3,878,115 | 4/1975 | Souillard et al. | 508/391 |
| 4,479,882 | 10/1984 | Zoleski et al. | 508/460 |
| 4,734,211 | 3/1988 | Kennedy | 508/391 |
| 4,876,020 | 10/1989 | Zon et al. | 508/460 |
| 5,352,373 | 10/1994 | Goto | 508/391 |
| 5,498,353 | 3/1996 | Lin et al. | 508/391 |
| 5,599,780 | 2/1997 | Koyama et al. | 508/391 |
| 5,719,107 | 2/1998 | Outten et al. | 508/586 |
| 5,726,133 | 3/1998 | Blahey et al. | 508/391 |
| 5,792,735 | 8/1998 | Cook et al. | 508/460 |
| 5,804,537 | 9/1998 | Boffa et al. | 508/391 |

FOREIGN PATENT DOCUMENTS

| | | |
|---|---|---|
| 0 225 580 | 6/1987 | European Pat. Off. . |
| 0 394 468 | 10/1990 | European Pat. Off. . |
| 0 473 200 | 3/1992 | European Pat. Off. . |

OTHER PUBLICATIONS

A. S. Galiano–Roth, et al., Draft manuscripts of ACS—Division of Petroleum Chemistry Symposium of "Processing Characterization, and Application of Lubricant Base Oils", 22 pages, "Effect FO Hydroprocessing on Lubricant Base Stock Compositition and Product Performance", Aug. 25 and 26, 1992.

E. Richard Booser, CRC Handbook of Lubrication , vol. 1, pp. 1–44, "Theory and Practice of Tribology", 1983.

*Primary Examiner*—Margaret Medley
*Assistant Examiner*—Cephia D. Toomer
*Attorney, Agent, or Firm*—Oblon, Spivak, McClelland, Maier & Neustadt, P.C.

[57] ABSTRACT

Disclosed is a diesel engine oil composition containing a lube oil base and one or more metallic detergent-dispersants selected from among a perbasic alkaline earth metal sulfonate, phenolate, and salicylate. The total phosphorus content of the composition is suppressed to 100 ppm by weight or less, to thereby provide diesel engine oil compositions having excellent oxidation stability and wear resistance.

24 Claims, No Drawings

DIESEL ENGINE OIL COMPOSITION

BACKGROUND OF THE INVENTION

1. Field of the Invention

The present invention relates to a diesel engine oil composition, and more particularly, to a diesel engine oil composition suitable for medium-speed diesel engines for marine use and diesel generating power plant.

2. Background Art

In marine diesel engines or diesel engines for power plant, particularly in medium-speed diesel engines, a phenomenon of sudden increase in engine oil consumption has become a issue. The sudden increase phenomenon is attributable to the conditions between rings and liners in the engines; i.e., sticking of the rings by products of engine oil degradation or poor lubrication between the rings and liners. In other words, degradation of engine oils and decrease of lubricity, particularly a decrease in wear resistance of engine oils, play a significant role in the sudden increase of oil consumption. Thus, the service life of an engine oil expires upon occurrence of the sudden increase in oil consumption. Oil consumption may be affected by degradation of specific components in the oil during use, since almost no variation is observed in oil consumption among fresh engine oils. In view that engine oils having long service lives have excellent oxidation stability and wear resistance, development of engine oils which are excellent in both properties is demanded. Japanese Patent Application Laid-Open (kokai) No. 7-197067 discloses an engine oil additive comprising a specific perbasic or neutral sulfonate in combination with a specific polyalkenylsuccinimide and zinc dialkyldithiophosphate. However, the additive has poor characteristics with respect to both oxidation stability and wear resistance.

SUMMARY OF THE INVENTION

The present invention was made in view of the foregoing, and an object of the invention is to provide a diesel engine oil composition having excellent oxidation stability and wear resistance.

The present inventors have conducted earnest studies, and have found that the above object is effectively attained by use of a detergent-dispersant comprising a specified perbasic alkaline earth metal compound and by regulation of the amount of specified elemental components.

Accordingly, the present invention provides a diesel engine oil composition comprising a lube oil base and one or more metallic detergent-dispersants selected from among a perbasic alkaline earth metal sulfonate, phenolate, and salicylate, wherein the total phosphorus content is 100 ppm by weight or less, preferably 70 ppm by weight or less.

In a preferred embodiment of the present invention, there is provided a diesel engine oil composition having a total base number of 15–50 mgKOH/g.

In a further preferred embodiment of the present invention, there is provided a diesel engine oil composition wherein the sum of the total nitrogen content and the total phosphorus content is 150 ppm by weight or less.

Furthermore, in a particularly preferred embodiment of the present invention, there is provided a diesel engine oil composition having a total nitrogen content of 50 ppm by weight or less.

MODES FOR CARRYING OUT THE INVENTION

Modes for carrying out the present invention will next be described.

The diesel engine oil composition of the present invention may be used in a variety of engines such as marine engines and engines for diesel generating power plant, and is preferably used in a medium-speed diesel engine having a speed of 200–1500 rpm, preferably 300–1300 rpm. These diesel engines typically have a power output of 100–30,000 HP, preferably 500–20,000 HP. In these diesel engines, a lube oil may be contaminated with unused fuel, combustion residues, and sludge produced by reaction between an acidic substance derived from sulfur contained in the fuel and a metallic dispersant. Particularly preferably, the diesel engine oil composition of the present invention is used in a diesel engine equipped with means to remove sludge, etc., such as a large-scale filter, strainer, or a centrifugal separator.

As a lube oil base in the diesel engine oil composition of the present invention, there may be used a mineral oil and/or a synthetic oil having a kinematic viscosity at 100° C. of 3–35 $mm^2/s$, more preferably 8–25 $mm^2/s$. When the kinematic viscosity of the base oil is excessively high, supply of the lube oil to a lubrication part is poor; whereas when kinematic viscosity is excessively low, the vapor pressure is high, resulting in a disadvantageously high rate of oil consumption. No particular limitation is imposed on the pour point, which is an index for low-temperature fluidity, and a pour point of −10° C. or less is preferred. Furthermore, the total amount of nitrogen contained in the base oil is preferably 40 ppm by weight or less, more preferably 30 ppm by weight or less. When the total nitrogen content in the base oil is excessively high, sludge formation increases as a result of an increase in the degradation of the lube oil.

The mineral and synthetic oils may be selected from a wide variety thereof according to use. Examples of the mineral oils include a paraffin-type mineral oil, a naphthene-type mineral oil, and an intermediate base crude oil. Specific examples include a light neutral oil, an intermediate neutral oil, a heavy neutral oil, and a bright stock.

Examples of the synthetic oils include poly-α-olefin, α-olefin copolymer, polybutene, alkylbenzene, polyol ester, a dibasic acid ester, polyoxyalkylene glycol, a polyoxyalkylene glycol ester, a polyoxyalkylene glycol ether, and a hindered ester.

These oils—which serve as base oils—may be used singly or in combination of two or more species, and the mineral oil(s) and the synthetic oil(s) may be used in combination.

The metallic detergent-dispersant incorporated in the lube oil base is selected from among a perbasic alkaline earth metal sulfonate, phenate, and salicylate. Of these, a perbasic alkaline earth metal salicylate is preferred.

The detergent-dispersant preferably has a total base number of 100–600 mgKOH/g (JIS K-2501: perchlorate method), particularly 120–500 mgKOH/g. When the base number is excessively low, a large amount of the dispersant is required to obtain the effect, which is economically disadvantageous; whereas when the base number is excessively high, the ash content of the lube oil increases to invite the risk of formation of a large amount of deposit.

The perbasic alkaline earth metal sulfonates, which are alkaline earth metal salts of a variety of sulfonic acids, are typically obtained through carbonation of a variety of alkaline earth metal sulfonates. Examples of the sulfonic acids include aromatic petroleum sulfonic acid, alkylsulfonic acid, arylsultonic acid, and alkylarylsulfonic acid. Specific examples include dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid, and naphthalenesulfonic acid.

The perbasic alkaline earth metal phenolates, which are alkaline earth metal salts of an alkylphenol or a sulfidized alkylphenol, are typically obtained through carbonation of an alkaline earth metal salt of alkylphenol or sulfidized alkylphenol.

The perbasic alkaline earth metal salicylates, which are alkaline earth metal salts of an alkylsalicylic acid, are typically obtained by the following steps: alkylation of phenol with C8–C18 α-olefin, introduction of a carboxyl group by Kolbe-Schmitt reaction, double-decomposition, and carbonization. Examples of the alkylsalicylic acids include dodecylsalicylic acid, dodecylmethylsalicylic acid, tetradecylsalicylic acid, hexadecylsalicylic acid, octadecylsalicylic acid, and dioctylsalicylic acid.

Examples of the alkaline earth metal of the above- mentioned alkaline earth metal sulfonates, phenolates, and salicylates include calcium, barium, and magnesium, with calcium being preferred in view of effect.

In the present invention, the above-described metallic detergent-dispersant may be used singly or in combination of two or more species. It is preferably incorporated in an amount of 5–40% by weight based on the total amount of the composition, more preferably 10–30% by weight. When the amount of the metallic detergent-dispersant is 5% by weight or less, poor wear resistance and oxidation stability result, whereas when the amount is in excess of 40% by weight, there may not be obtained an effect commensurate with the amount of incorporated detergent-dispersant.

The total phosphorus content in the diesel engine oil composition of the present invention is 100 ppm by weight or less, preferably 70 ppm by weight or less, particularly preferably 30 ppm by weight or less. When the total phosphorus content is excessively high, an acidic substance in the lube oil increases in amount to result in easy sludge formation during the step of oxidation-induced degradation.

The total base number of the diesel engine oil composition of the present invention must be adjusted to 15–50 mgKOH/g (JIS K-2501: perchlorate method), preferably 20–40 mgKOH/g, in consideration of poor neutralization ability to an acid at excessively low values and a large amount of deposit formation at excessively high values.

The sum of the total nitrogen content and the total phosphorus content of the diesel engine oil composition of the present invention is preferably adjusted to 150 ppm by weight or less, more preferably 90 ppm by weight or less, particularly preferably 70 ppm by weight or less. Too great a sum may result in easy sludge formation during the step of oxidation-induced degradation.

Moreover, the total nitrogen content of the diesel engine oil composition of the present invention is preferably adjusted to 50 ppm by weight or less, more preferably 30 ppm by weight or less. An excessively high nitrogen content may result in easy sludge formation during the step of oxidation-induced degradation.

The composition of the present invention is obtained by incorporating the above-described metallic detergent-dispersant into a lube oil base. Generally, the composition may further contain additives such as an antioxidant, a viscosity index improver, a metal deactivator, a pour point depressant, an anti-wear agent, a defoaming agent, or an extreme pressure agent, in order to maintain essential characteristics of the lube oil. No particular limitation is imposed on the additives, and a wide variety of conventionally known additives may be used. Examples of the antioxidant, which may be used in an amount of 0.05–2% by weight based on the total amount of the composition, include an amine such as alkylated diphenylamine or phenyl-a-naphthylamine, and a phenolic compound such as 2,6-di-t-butylphenol or 4,4'-methylenebis(2,6-di-t-butylphenol). Examples of the viscosity index improver, which may be used in an amount of 0.5–30% by weight based on the total amount of the composition, include poly(methyl methacrylate), polyisobutylene, ethylene-propylene copolymer, styrene-isoprene copolymer, and hydrogenated styrene-butadiene copolymer. Examples of the metal deactivator, which may be used in an amount of 0.005–1% by weight based on the total amount of the composition, include benzotriazole, thiadiazole, and an alkenylsuccinate ester. Examples of the pour point depressant, which may be used in an amount of 0.01–1% by weight based on the total amount of the composition, include poly(alkyl methacrylate) and polyalkylstryene. Examples of the anti-wear agent, which may be used in an amount of 0.1–3% by weight based on the total amount of the composition, include an organic molybdenum compound such as MoDTP or MoDTC; an organic zinc compound such as ZnDTP; an organic boron compound such as alkylmercaptyl borate; graphite; molybdenum disulfide; antimony sulfide; a boron compound; and polytetrafluoroethylene. Examples of the defoaming agent, which may be used in an amount of 0.0005–1% by weight based on the total amount of the composition, include dimethylpolysiloxane and polyacrylate. Examples of the extreme pressure agent, which may be used in an amount of 0.1–15% by weight based on the total amount of the composition, include sulfidized fat and diallyl disulfide. When the above-described additives are compounds that contain nitrogen or phosphorus, the total amount of nitrogen and/or phosphorus in the above-described lube oil composition should be regulated in consideration of these components in the additives.

EXAMPLES

The present invention will next be described in detail by way of examples, which should not be construed as limiting the invention thereto.

Examples 1 to 3 and Comparative Examples 1 and 2

The components of the composition were mixed in the proportions specified in Table 1 to thereby obtain diesel engine oil compositions of Examples and Comparative Examples. The total base numbers of the diesel engine oil compositions of Examples and Comparative Examples were regulated to 30 mgKOH/g (JIS K-2501; perchlorate method). These compositions of Examples and Comparative Examples were subjected to an oxidation stability test and a wear resistance test performed in the below-described manner. The results are shown in Table 1.

(1) Oxidation stability test

An ISOT test was performed according to "Oxidation stability test for internal combustion engine oil" (JIS K-2514). Briefly, the test was performed by the following steps: placing an iron-steel sheet in an engine oil, stirring the oil at 165° C., and measuring the total base number after 96 hours according to JIS K-2501 (hydrochloric acid method).

(2) Wear resistance test (four-ball load carrying capacity test)

In order to evaluate wear resistance of the engine oils, oil-film formation between frictional interfaces, an important factor of wear resistance, was evaluated under the following conditions:

Test apparatus: Soda's four-ball test apparatus

Revolutions of the revolving ball: 500 rpm

Oil temperature: 80° C.

Evaluation method: While the hydraulic load was gradually increased from 0.5 kg/cm$^2$ by 0.5 kg/cm$^2$ every three minutes, there was measured the oil pressure at which electric conductivity was observed between the revolving ball and fixed balls.

TABLE 1

| | | Ex. 1 | Ex. 2 | Ex. 3 | Comp. Ex. 1 | Comp. Ex. 2 |
|---|---|---|---|---|---|---|
| Compn. Wt. % | Base oil (1)*1 | 84.1 | — | 83.2 | 83.7 | 82.8 |
| | Base oil (2)*2 | — | 88.5 | — | — | — |
| | Ca-Phenate*3 | 3.8 | 5.8 | 3.8 | 3.8 | 3.8 |
| | Ca-Salicylate*4 | 12.1 | — | 12.1 | 12.1 | 12.1 |
| | Ca-Sulfonate*5 | — | 5.7 | — | — | — |
| | Zn-DTP | — | — | — | 0.4 | 0.4 |
| | Bis alkenyl-succinic imide*6 | — | — | 0.9 | — | 0.9 |
| Total nitrogen (wt. ppm) | | ≦5 | 32 | 100 | — | 100 |
| Total phosphorus (wt. ppm) | | ≦10 | ≦10 | ≦10 | 300 | 300 |
| Total base number After ISOT test*7 | | 8.0 | 6.0 | 4.5 | 4.0 | 3.5 |
| Four ball test (kg/cm$^2$) | | 4.0 | 4.0 | 3.5 | 3.0 | 2.5 |

*1: Highly purified paraffin-base mineral oil, kinematic viscosity: 10 mm$^2$/s (100° C.)
*2: Solvent-purified paraffin-base mineral oil, kinematic viscosity: 10 mm$^2$/s (100° C.)
*3: Total base number: 250 mgKOH/g (JIS K-2501: perchlorate method)
*4: Total base number: 170 mgKOH/g (JIS K-2501: perchlorate method)
*5: Total base number: 270 mgKOH/g (JIS K-2501: perchlorate method)
*6: Number average molecular weight of polyisobutenyl group 1,000; nitrogen content 1.1% by weight
*7: mgKOH/g (JIS K-2501; hydrochloric acid method)

As described above, the diesel engine oil composition of the present invention has excellent oxidation stability and wear resistance, and is particularly suitable as a medium-speed-diesel engine oil for marine use or for provate power generation.

What is claimed is:

1. A diesel engine oil composition comprising a lube oil base and one or more metallic detergent-dispersants selected from the group consisting of a per basic alkaline earth metal sulfonate, phenolate, and salicylate, wherein the total base number of said detergent dispersants is from 100 to 500 mg KOH/g, and wherein the total phosphorous content of the composition is 100 ppm by weight or less, and wherein the total base number of the composition is 15–50 mgKOH/g.

2. The diesel engine oil composition according to claim 1, wherein the sum of a total nitrogen content and the total phosphorus content of the composition is 150 ppm by weight or less.

3. The diesel engine oil composition according to claim 1, wherein a total nitrogen content of the composition is 50 ppm by weight or less.

4. The diesel engine oil composition according to claim 1, wherein the total phosphorus content of the composition is 70 ppm by weight or less.

5. The diesel engine oil composition according to claim 4, wherein the sum of the total nitrogen content and the total phosphorus content of the composition is 90 ppm by weight or less.

6. The diesel engine oil composition according to claim 4, wherein a total nitrogen content of the composition is 30 ppm by weight or less.

7. The diesel engine oil composition according to claim 1, wherein the kinematic viscosity of the lube oil base at 100° C. is between about 8–35 mm$^2$/s.

8. The diesel engine oil composition according to claim 1, wherein the amount of the detergent-dispersants is about 5–40% by weight of the composition.

9. A diesel engine oil composition comprising a mineral lube oil base and one or more metallic detergent-dispersants selected from the group consisting of a per basic alkaline earth metal sulfonate, phenolate, and salicylate, wherein the total base number of said detergent dispersants is from 100 to 500 mg KOH/g, and wherein the total phosphorous content of the composition is 100 ppm by weight or less.

10. The diesel engine oil composition according to claim 9, wherein the sum of the total nitrogen content and the total phosphorus content of the composition is 150 ppm by weight or less.

11. The diesel engine oil composition according to claim 9, wherein the total nitrogen content of the composition is 50 ppm by weight or less.

12. The diesel engine oil composition according to claim 9, wherein the total phosphorus content of the composition is 70 ppm by weight or less.

13. The diesel engine oil composition according to claim 12, wherein the sum of the total nitrogen content and the total phosphorus content of the composition is 90 ppm by weight or less.

14. The diesel engine oil composition according to claim 12, wherein the total nitrogen content of the composition is 30 ppm by weight or less.

15. A method for preparing a diesel engine oil composition having enhanced wear resistance and oxidation stability comprising combining a lube oil base with one or more metallic detergent-dispersants selected from the group consisting of a per basic alkaline earth metal sulfonate, phenolate, and salicylate, and one or more additives selected from the group consisting of antioxidants, viscosity index improvers, metal deactivators, pour point depressants, anti-wear agents, defoaming agents, and extreme pressure agents, and selecting said lube oil base, detergent-dispersant and additive such that the total phosphorous content of the composition is 100 ppm by weight or less.

16. The method according to claim 15, wherein the sum of a total nitrogen content and the total phosphorus content of the composition is 150 ppm by weight or less.

17. The method according to claim 15, wherein the total nitrogen content of the composition is 50 ppm by weight or less.

18. The method according to claim 15, wherein the total phosphorus content of the composition is 70 ppm by weight or less.

19. The method according to claim 15, wherein the kinematic viscosity of the lube oil base at 100° C. is between about 8–35 $mm^2/s$.

20. The method according to claim 15, wherein the amount of the one or more detergent-dispersants is about 5–40% by weight of the diesel engine oil composition.

21. The method according to claim 15, wherein the sum of the total nitrogen content and the total phosphorus content of the diesel engine oil composition is 90 ppm by weight or less.

22. The method according to claim 15, wherein the total nitrogen content of the diesel engine oil composition is 30 ppm by weight or less.

23. The method according to claim 15, wherein the total base number of the one or more metallic detergent-dispersants is 100–500 mgKOH/g.

24. The method according to claim 15, wherein the diesel engine oil composition has a total base number of 15–40 mgKOH/g.

* * * * *